US007588081B2

(12) United States Patent
Pfeiffer et al.

(10) Patent No.: US 7,588,081 B2
(45) Date of Patent: Sep. 15, 2009

(54) METHOD OF MODIFYING PERMEABILITY BETWEEN INJECTION AND PRODUCTION WELLS

(75) Inventors: Jochen Pfeiffer, Moscow (RU); Curtis L. Boney, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 244 days.

(21) Appl. No.: 11/738,020

(22) Filed: Apr. 20, 2007

(65) Prior Publication Data

US 2007/0267191 A1 Nov. 22, 2007

Related U.S. Application Data

(60) Provisional application No. 60/747,472, filed on May 17, 2006.

(51) Int. Cl.

| | |
|---|---|
| ***E21B 43/20*** | (2006.01) |
| ***E21B 43/22*** | (2006.01) |
| ***E21B 47/06*** | (2006.01) |
| ***E21B 47/10*** | (2006.01) |

(52) U.S. Cl. ..... 166/252.5; 166/250.07; 166/250.14; 166/270; 166/275; 166/400; 73/152.55

(58) Field of Classification Search ..... None
See application file for complete search history.

(56) References Cited

U.S. PATENT DOCUMENTS

| | | | | |
|---|---|---|---|---|
| 3,255,820 | A * | 6/1966 | Brandon | 166/249 |
| 3,349,844 | A * | 10/1967 | Rhea et al. | 166/252.1 |
| 3,478,823 | A * | 11/1969 | Murphy | 166/400 |
| 3,713,489 | A | 1/1973 | Fast | |
| 3,846,559 | A | 11/1974 | Stevens | |
| 4,147,211 | A | 4/1979 | Sandiford | |
| 4,501,329 | A | 2/1985 | DePriester | |
| 6,152,226 | A * | 11/2000 | Talwani et al. | 166/252.4 |
| 7,243,720 | B2 * | 7/2007 | Ligthelm | 166/270 |

FOREIGN PATENT DOCUMENTS

| | | | |
|---|---|---|---|
| WO | 2004042187 | A1 | 5/2004 |

* cited by examiner

*Primary Examiner*—George Suchfield
(74) *Attorney, Agent, or Firm*—Robin Nava; Dave Cate; Rachel Greene

(57) ABSTRACT

The invention provides a method of treating a subterranean formation penetrated by at least one injection well and at least one production well, the method comprising the steps of a) analyzing the injection well, the production well, and reservoir contained in the subterranean formation; b) selecting at least one fluid and at least one permeability reducer to be placed in flow ways contained within the formation; and c) performing a formation permeability modification using the selected fluids and at least one permeability reducer, whereby the flow of injected driving fluid between the injection well and production well is substantially reduced. In one embodiment, the method of analyzing the injection well, the production well, and reservoir contained in the subterranean formation includes the steps of evaluation of completion information, reservoir data, or both.

15 Claims, No Drawings

METHOD OF MODIFYING PERMEABILITY BETWEEN INJECTION AND PRODUCTION WELLS

RELATED APPLICATION DATA

This application is based upon U.S. Provisional Patent Application No. 60/747,472, filed May 17, 2006, and claims the benefit of the filing date thereof.

BACKGROUND OF THE INVENTION

The invention relates to a method for inhibiting breakthrough of driving fluid via a relatively permeable geological layer of a stratified hydrocarbon-bearing subterranean formation into a production well. More particularly, the invention relates to a method for reducing the permeability of one or more relatively permeable geological layers of a subterranean formation.

When producing hydrocarbons from a subterranean formation, water and/or steam may be injected into an injection well to help drive the production of hydrocarbons. The hydrocarbon is pressed by the water, steam, steam foam or froth and/or other driving fluid through the geological layers into the production well, thereby enhancing the production of hydrocarbon. Stimulation of hydrocarbon production by injection of driving fluids into the formation is a technology used in Improved Oil Recovery (IOR).

The break through of driving fluid from injection wells to production wells is a common problem, in areas such as heavy oil producing areas in Alaska and Canada. The flow path is thought to be a combination of fractures and worm holes. Often a possible flow through matrix is suggested. This breakthrough of driving fluid is a big disadvantage, as the water/oil ratio retrieved from the production well may rapidly increase and become more and more unfavorable during the lifetime of the oil field.

In some cases, produced water is often disposed of by pumping the water into injection wells. In some instances, however, there exist subterranean flow ways from the injection well to the production well, such that the injected water flows to the production well. This can lead to an increase in the amount of water produced, or in some situations (such as heavy oil) may destabilize the producing formation. Often the flow ways are flow-paths along fractures and fissures, although in some cases the flow may be through the formation matrix.

Therefore, it would be be desirable to have methods which shut off or significantly minimize the flow of injected driving fluid to the producing wellbore. Such a need is met, at least in part, by the following invention.

SUMMARY OF THE INVENTION

The invention provides a method of treating a subterranean formation penetrated by at least one injection well and at least one production well, the method comprising the steps of a) analyzing the injection well, the production well, and reservoir contained in the subterranean formation; b) selecting at least one fluid and at least one permeability reducer to be placed in flow ways contained within the formation; and c) performing a formation permeability modification using the selected fluids and at least one permeability reducer, whereby the flow of injected driving fluid between the injection well and production well is substantially reduced.

In one embodiment, the method of analyzing the injection well, the production well, and reservoir contained in the subterranean formation includes the steps of evaluation of completion information, reservoir data, or both.

In another embodiment, the method further includes the step of performing a data injection test.

In yet another embodiment, at least one permeability reducer is mixed with a carrier fluid and introduced into the formation through the injection well.

In yet another embodiment, the formation permeability modification is conducted using a plurality of mixtures of permeability reducers and carrier fluids

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system related and business related constraints, which will vary from one implementation to another. Moreover, it will be appreciated that such a development effort might be complex and time consuming but would nevertheless be a routine undertaking for those of ordinary skill in the art having the benefit of this disclosure.

The invention relates to a method for inhibiting breakthrough of driving fluid via a relatively permeable geological layer of a stratified hydrocarbon-bearing subterranean formation into a production well. More particularly, the invention relates to a method for reducing the permeability of one or more relatively permeable geological layers of a subterranean formation. Inventors have discovered an engineered approach to determining the subterranean formation characteristics, testing, selecting an appropriate fluid, and then injecting the fluid into the injection well to modify the formation, in such way that the flow of injected driving fluid toward the producing wellbore is shut off or significantly minimized by substantially reducing permeability. In some embodiments of the invention, the method includes the use of a fluid having specified particle sizes particularly tailored to the determined flow ways. In some other embodiments, the fluid uses a polymer selected based on the determined flow ways to reduce permeability.

Different from state of the art methods based on a fluid or a combination of fluids that plug the flow ways existing between injectors and producers using a reaction down hole inside the reservoir (such as by building filter cake or reaction of different fluids), in methods of the invention, the geometry or size of the flow path is determined, and then the flow path is substantially plugged with solids and/or polymer loaded fluid systems, where the solids or polymer essentially behave as a permeability reducer. Particle size distribution of the solids based permeability reducer is one tool used to reduce permeability of the reservoir, which are high in solids of a wide range and stable with low settling rate.

In methods of the invention where solids are used for permeability reduction, a solids component is selected and used in conjunction with a fluid, such as a carrier fluid. The particle size distribution of the solids component is selected so that the fluid delivers the solids to the flow ways, and plugs off flow ways between the injection well and the producing well. In selecting the appropriate carrier fluid and solids component, the methods use an engineered approach which includes determining and reviewing initial well information, performing a well test to determine appropriate particle sizes, selecting a fluid, and performing the formation permeability modification. Hence, some method embodiments of the invention generally include: 1) analyzing the well and reservoir; 2) selecting the fluids (carrier, spacer, etc.) and permeability reducer (i.e. solids, polymer, or mixture of solids & polymer) to be placed in flow ways; and, 3) performing the formation permeability modification using the selected fluids and permeability reducer.

In analyzing the well and reservoir, any suitable analysis means, test, or data may be used. For example, well data based upon available completion information or reservoir data may be used in the analysis. Completion information may include well diagrams, while reservoir data may include production data (pressure-rate-time), wireline/LWD logging data, well testing data, injection data (pressure-rate-time), and the like.

As part of the analysis of the well and reservoir, a data injection test may be conducted. The data injection test may be conducted in the formation, and may be designed based upon available completion information or reservoir data. In one embodiment, basic pressure responses are monitored during the test, and viscous fluid portions containing solids of known particle size are pumped to determine type of injectivity, such as secondary porosity (indicating fractures, fissures, vugs, etc.), or primary porosity (indicative of the formation matrix). Solids components of different particle sizes and distribution may be varied in different portions for testing purposes, i.e. first for determining injectivity into secondary porosity, then into the matrix. The viscous fluid portions containing solid components of known particle size and tri-modal composition may then be introduced into the injection wellbore to locate pinch points, or even to identify fissures rather than fractures. Viscosity of the fluid(s) carrying solids component(s) is generally such that the solids are adequately suspended during transport through the wellbore and into the formation. Viscosity and fluid-loss may play a role as it is desirable to enable the solids to be carried into the formation reservoir, but then allow the solids settle between the injector and producer to plug the flow path of least resistance.

Fluid parameters as well as pressures, rates and volumes measured or collected during the test are then condensed for analysis. The mixtures of fluid(s) and solids component(s) may be selected after evaluating the response of the formation to the fluids pumped during the injection test. For example, for the main treatment, if a significant pressure increase (i.e. >500 psi) is observed during the passage of one of the solids portions pumped during the test, the composition of that portion may be best suited for the main treatment. This type of pressure analysis together with the well data and formation logs is useful in design of the treatment method.

In some injection tests, to distinguish between substantially fracture versus substantially matrix solids transport and placement, the first portion pumped containing the finest sized solids may indicate matrix flow path plug off, since when all or some flow is through the secondary porosity (fractures, fissures, vugs, etc.), the flow ways will not plug with this first portion. Also, it may no be necessary to know the exact ratio of flow through the primary or secondary porosity as long as a portion of fluid will be injected into the secondary porosity.

Typically, when solids are used for permeability reduction, useful fluids are those that can carry the solids and will show stability throughout the treatment. Towards the end of the treatment method, the loss of carrying properties and a high fluid-loss is preferable, and this may be achieved using different breaker systems, as used in stimulation treatments. Also, formation temperature may be considered in selection of fluids to avoid loss of suspension properties for carrying the solids, but still possessing adequate fluid-loss properties.

In a next step of methods of the invention, based upon analysis of the well and reservoir, fluid(s) and at least one permeability reducer are selected to perform the permeability modification. As mentioned hereinabove, the permeability reducer is to be placed in flow ways contained within the formation. The fluid, or fluids, carrying the permeability reducer may contain a viscosifying agent adequate to suspend a solids component, for example, during transport through the wellbore and into the formation.

In those cases where data injection testing is conducted, the result may call for, by non-limiting example, a solids free fluid incorporating a polymer for permeability reduction (such as cases for injection into a matrix with less than about 2 Darcy permeability), fluid containing fine grade solids (such as injection into matrix with more than about 2 Darcy permeability), or fluid containing large grade solids (such as for non-matrix injection). The previous are only estimates, and the sizing of solids making up the solids component or the selection of polymer will depend on pressure response during the data injection test. The use of cementations materials in the composition may depend upon the availability of coiled tubing (CT) for clean out on both ends (injector and producer), or if shut in of the formation is possible (i.e. from cross flow from other wells).

Spacer fluids and/or over flush may also be fluids used in some methods of the invention. For illustration, fluids without a formation permeability reducing solids component or polymer, for example, such as acids, resins or hydrocarbons may be first pumped for such purposes as to clean or coat the formation, to reduce viscosity of treatment fluid, or even to contaminate and reduce permeability. Also, these fluids may be pumped after placement if the solids for such purposes as to consolidate the packing, to reduce viscosity of treatment fluid, or even to contaminate and reduce permeability.

In methods of the invention, the next step is to perform the formation permeability modification. In some embodiments of the invention, after the fluid and permeability reducer composition is determined, the actual treatment should consider whether or not standard cementing or stimulation equipment can be used. For example: a high pressure pump unit capable of pumping the designed rates and pressures has to be chosen; because the quality of the treating fluid is of priority, a paddle blender may be necessary; whether all fluids should be premixed; where possible a CT should be used for placement of the treatment fluid. All treatment parameters should be monitored (pressure, rate, volumes and density). Preferably, a down hole pressure gauge should be used to observe DH injection pressure.

As an example of performing the modification while monitoring pressure, in some cases, in the performance of the permeability modification, a continuous pressure increase is predicted as the treating fluid enters the formation. If no pressure increase is observed when half of the treating fluid has entered the formation the pump rate may be decreased. When a significant pressure increase (for example more than 1000 PSI above initial injection pressure is equal to squeeze pressure) is observed towards the end of the job, shut down and give 15 min for the material to compact. If pressure drops, then, the pressure may be increased back to initial squeeze pressure.

Any suitable material may be used as the solids based permeability reducer so long that it functions to substantially block flow paths upon placement. Particles forming the solid permeability reducer used in some embodiments of the invention may be high strength particles which are resin coated to improve the strength and prevent fracturing due to stresses. Particle candidate selection may be based on such factors as the rock strength, injection pressures, types of injection fluids, or even treatment design. Other suitable materials include, but are not limited to, sand, sintered bauxite, glass beads, ceramic materials, naturally occurring materials, or similar materials. Mixtures of proppants can be used as well. Naturally occurring materials may be underived and/or unprocessed naturally occurring materials, as well as materials based on naturally occurring materials that have been processed and/or derived.

In some embodiments of the invention, the particles used may be resin coated (precured, partially cured and fully curable) or un-coated versions of high strength proppants (density 3.4-3.6 sgu) in all sizes 40/70 to 8/12 mesh; intermediate strength proppants (density 3.1-3.3 sgu) in all sizes 40/70 to 8/12 mesh; even light weight proppants (density 2.6-0.2.8 sgu) in all sizes 40/70 to 8/12 mesh; or natural sands (density 2.55-0.2.75 sgu) in all sizes 40/70 to 8/12 mesh.

The concentration of particles may be any suitable concentration, and will preferably be below about 0.1 kilograms added per liter of fluid, preferably below about 0.05 kilograms added per liter of fluid, more preferably below about 0.03 kilograms added per liter of fluid. Also, as described above, any of the particles can further be coated with a resin to potentially improve the strength, clustering ability, and flow back properties of the particle.

Fluids used according to the invention may comprise an aqueous medium which is based upon, at least in part, produced water. The aqueous medium may also contain some water, seawater, or brine. In those embodiments of the invention where the aqueous medium is a brine, the brine is water comprising an inorganic salt or organic salt. Preferred inorganic salts include alkali metal halides, more preferably potassium chloride. The brine phase may also comprise an organic salt more preferably sodium or potassium formate. Preferred inorganic divalent salts include calcium halides, more preferably calcium chloride or calcium bromide. Sodium bromide, potassium bromide, or cesium bromide may also be used. The salt is chosen for compatibility reasons i.e. where the reservoir drilling fluid used a particular brine phase and the completion/clean up fluid brine phase is chosen to have the same brine phase.

Fluids useful in the invention may include a viscosifying agent that may be a polymer that is either crosslinked or linear, a viscoelastic surfactant, clay (bentonite and/or attapulgite), or any combination thereof. For hydraulic fracturing or gravel packing, or a combination of the two, aqueous fluids for pads or for forming slurries are generally viscosified. Viscoelastic surfactants ("VES's") form appropriately sized and shaped micelles that add viscosity to aqueous fluids. Small amounts of polymers may be used to increase the viscosity or for other purposes, for example as friction reducers. Breakers may also be used with VES's.

Examples of suitable polymers for use as viscosifying agents in the fluids, and/or used as the permeability reducing polymer used according to some embodiments of invention include, but are not necessarily limited to, guar gums, high-molecular weight polysaccharides composed of mannose and galactose sugars, or guar derivatives such as hydropropyl guar (HPG), carboxymethyl guar (CMG), carboxymethylhydropropyl guar (CMHPG). Cellulose derivatives such as hydroxyethylcellulose (HEC) or hydroxypropylcellulose (HPC) and carboxymethylhydroxyethylcellulose (CMHEC) may also be used in either crosslinked form, or without crosslinker in linear form. Xanthan, diutan, and scleroglucan, three biopolymers, have been shown to be useful as viscosifying agents. Polyacrylamide and polyacrylate polymers and copolymers are used typically for high-temperature applications. Of these viscosifying agents, guar, hydroxypropyl guar and carboxymethylhydroxyethyl guar are commonly used. In many instances, the polymeric viscosifying agent is crosslinked with a suitable crosslinker. Suitable crosslinkers for the polymeric viscosifying agents can comprise a chemical compound containing an ion such as, but not necessarily limited to, chromium, iron, boron, titanium, and zirconium. The borate ion is a particularly suitable crosslinking agent. When polymers are incorporated into fluids used in embodiments of the invention, the amount of polymer may range from about 0.01% to about 1.00%, and preferably about 0.10% to about 0.40% by weight of total fluid weight.

A viscoelastic surfactant (VES) may be used in fluids of some embodiments of the invention, as a viscosifying agent. The VES may be selected from the group consisting of cationic, anionic, zwitterionic, amphoteric, nonionic and combinations thereof, such as those cited in U.S. Pat. No. 6,435,277 (Qu et al.) and U.S. Pat. No. 6,703,352 (Dahayanake et al.), each of which are incorporated herein by reference. The surfactants, when used alone or in combination, are capable of forming micelles that form a structure in an aqueous environment that contribute to the increased viscosity of the fluid (also referred to as "viscosifying micelles"). These fluids are normally prepared by mixing in appropriate amounts of VES suitable to achieve the desired viscosity. The viscosity of VES fluids may be attributed to the three dimensional structure formed by the components in the fluids. When the concentration of surfactants in a viscoelastic fluid significantly exceeds a critical concentration, and in most cases in the presence of an electrolyte, surfactant molecules aggregate into species such as micelles, which can interact to form a network exhibiting viscous and elastic behavior.

When a VES is incorporated into fluids used in embodiments of the invention, the VES can range from about 0.2% to about 15% by weight of total weight of fluid, preferably from about 0.5% to about 15% by weight of total weight of fluid, more preferably from about 0.5% to about 15% by weight of total weight of fluid. A particularly useful VES is Erucyl bis-(2-Hydroxyethyl) Methyl Ammonium Chloride.

The fluids used according to the invention may further comprise one or more members from the group of organic acids, organic acid salts, and inorganic salts. Mixtures of the above members are specifically contemplated as falling within the scope of the invention. This member will typically be present in only a minor amount (e.g. less than about 30% by weight of the liquid phase).

The organic acid is typically a sulfonic acid or a carboxylic acid, and the anionic counter-ion of the organic acid salts are typically sulfonates or carboxylates. Representative of such organic molecules include various aromatic sulfonates and carboxylates such as p-toluene sulfonate, naphthalene sulfonate, chlorobenzoic acid, salicylic acid, phthalic acid and the like, where such counter-ions are water-soluble. Most preferred as salicylate, phthalate, p-toluene sulfonate, hydroxynaphthalene carboxylates, e.g. 5-hydroxy-1-napthoic acid, 6hydroxy-1-napthoic acid, 7-hydroxy-1-napthoic acid, 1-hydroxy-2-naphthoic acid, preferably 3-hydroxy-2-naphthoic acid, 5-hydroxy-2-naphthoic acid, 7-hydroxy-2-napthoic acid, and 1,3-dihydroxy-2-naphthoic acid and 3,4-dichlorobenzoate.

The inorganic salts that are particularly suitable include, but are not limited to, water-soluble potassium, sodium, and ammonium salts, such as potassium chloride and ammonium chloride. Additionally, calcium chloride, calcium bromide and zinc halide salts may also be used. The inorganic salts may aid in the development of increased viscosity that is characteristic of preferred fluids. Further, the inorganic salt may assist in maintaining the stability of a geologic formation to which the fluid is exposed. Formation stability and in particular clay stability (by inhibiting hydration of the clay) is achieved at a concentration level of a few percent by weight and as such the density of fluid is not significantly altered by the presence of the inorganic salt unless fluid density becomes an important consideration, at which point, heavier inorganic salts may be used.

Friction reducers may also be incorporated as viscosifying agents into fluids useful according to the invention. Any friction reducer may be used. Also, polymers such as polyacrylamide, polyisobutyl methacrylate, polymethyl methacrylate and polyisobutylene as well as water-soluble friction reducers such as guar gum, polyacrylamide and polyethylene oxide may be used. Commercial drag reducing chemicals such as those sold by Conoco Inc. under the trademark "CDR" as described in U.S. Pat. No. 3,692,676 or drag reducers such as those sold by Chemlink designated under the trademarks "FLO 1003, 1004, 1005 & 1008" have also been found to be effective. These polymeric species added as friction reducers or viscosity index improvers may also act as excellent fluid loss additives reducing or even eliminating the need for conventional fluid loss additives.

Breakers may also be used in the invention. The purpose of this component is to "break" or diminish the viscosity of the fluid so that this fluid is more easily recovered from the fracture during cleanup. With regard to breaking down viscosity, oxidizers, enzymes, or acids may be used. Breakers reduce the polymer's molecular weight by the action of an acid, an oxidizer, an enzyme, or some combination of these on the polymer itself. In the case of borate-crosslinked gels, increasing the pH and therefore increasing the effective concentration of the active crosslinker, the borate anion, reversibly create the borate crosslinks. Lowering the pH can just as easily eliminate the borate/polymer bonds. At a high pH above 8, the borate ion exists and is available to crosslink and cause gelling. At lower pH, the borate is tied up by hydrogen and is not available for crosslinking, thus gelation caused by borate ion is reversible. Citric acid may also be used as a breaker, as described in U.S. published patent application 2002/0004464 (Nelson et al.), published on filed on Jan. 10, 2002, which is incorporated herein by reference.

While the invention may be useful for treating an injection well used in enhanced hydrocarbon recovery, the invention may also be used for any useful application where improvement in well injection rate and declination thereof are desired, for example, but not necessarily limited to, subterranean fluid disposal applications.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A method of treating a subterranean formation penetrated by at least one injection well and at least one production well, the method comprising:

a) initially analyzing the injection well, the production well, and reservoir contained in the subterranean formation;

b) then selecting at least one fluid and at least one permeability reducer to be placed in flow ways contained within the formation; and c) performing a formation permeability modification using the selected fluids and at least one permeability reducer, whereby the flow of injected driving fluid between the injection well and production well is substantially reduced.

2. The method of claim 1 wherein analyzing the injection well, the production well, and reservoir contained in the subterranean formation comprises the steps of evaluation of completion information, reservoir data, or both.

3. The method of claim 2 further comprising the step of performing a data injection test.

4. The method of claim 1 wherein the at least one permeability reducer is mixed with a carrier fluid and introduced into the formation through the injection well.

5. The method of claim 4 wherein the formation permeability modification is conducted using a plurality of mixtures of permeability reducers and carrier fluids.

6. The method of claim 1 wherein the fluid comprises a viscosifying agent adequate to suspend the permeability reducer during transport through a wellbore and into the formation.

7. The method of claim 1 wherein the permeability reducer is a solids component.

8. The method of claim 7 wherein said solids component is a high strength particulate material.

9. The method of claim 8, wherein said particulate material is selected from the group consisting of sand, sintered bauxite, glass beads, ceramic particles, and glass or ceramic microspheres.

10. The method of claim 7 wherein said solids component is a proppant.

11. The method of claim 1 wherein the permeability reducer is a polymer.

12. The method of claim 11 wherein the permeability reducer further comprises a solids component.

13. The method of claim 12 wherein said solids component is coated with said polymer.

14. The method of claim 13 wherein said permeability reducer is a polymer coated particulate material.

15. The method of claim 14 wherein said particulate material is selected from the group consisting of sand, sintered bauxite, glass beads, ceramic particles, and glass or ceramic microspheres.

* * * * *